US010329114B2

(12) United States Patent
Allen, Jr. et al.

(10) Patent No.: US 10,329,114 B2
(45) Date of Patent: Jun. 25, 2019

(54) STACKER HOPPER WITH FEED INTERRUPT

(71) Applicant: A.G. STACKER INC., Weyers Cave, VA (US)

(72) Inventors: Clarence C. Allen, Jr., Mt. Crawford, VA (US); Eric H. Crowe, Weyers Cave, VA (US); Micah C. Sundstrom, Staunton, VA (US); Eric Stempihar, Bridgewater, VA (US); Kevin G. Gorby, Harrisonburg, VA (US)

(73) Assignee: A. G. Stacker Inc., Weyers Cave, VA (US)

( * ) Notice: Subject to any disclaimer, the term of this patent is extended or adjusted under 35 U.S.C. 154(b) by 0 days.

(21) Appl. No.: 15/354,671

(22) Filed: Nov. 17, 2016

(65) Prior Publication Data

US 2017/0137252 A1 May 18, 2017

Related U.S. Application Data

(60) Provisional application No. 62/256,421, filed on Nov. 17, 2015.

(51) Int. Cl.
*B65H 31/36* (2006.01)
*B65H 31/38* (2006.01)
(Continued)

(52) U.S. Cl.
CPC ..... *B65H 31/38* (2013.01); *B65H 29/247* (2013.01); *B65H 31/10* (2013.01); *B65H 31/3054* (2013.01); *B65H 31/32* (2013.01); *B65H 31/3063* (2013.01); *B65H 31/36* (2013.01); *B65H 2701/1762* (2013.01)

(58) Field of Classification Search
CPC ..... B65H 3/06; B65H 31/34; B65H 31/38; B65H 31/36; B65H 31/40; B65H 31/32; B65H 31/3054; B65H 31/3063
See application file for complete search history.

(56) References Cited

U.S. PATENT DOCUMENTS 4,359,218 A 11/1982 Karis
4,796,879 A 1/1989 Martini et al.
(Continued)

FOREIGN PATENT DOCUMENTS

DE 3122451 C2 2/1985

*Primary Examiner* — Howard J Sanders
(74) *Attorney, Agent, or Firm* — J-TEK Law PLLC; Jeffrey D. Tekanic; Scott T. Wakeman

(57) ABSTRACT

A sheet stacking system includes a conveyor having a discharge end, a hopper at the discharge end configured to receive the sheets ejected from the discharge end and guide the sheets as they fall in a cascade path onto a platform associated with the hopper, the falling sheets forming a main stack on the platform, the hopper including a backstop facing the discharge end of the conveyor such that the sheets ejected from the discharge end impact against the backstop before forming the main stack, and a first accumulator having at least one first support extending through the backstop and shiftable from a retracted position to an extended position, the at least one first support being movable vertically relative to the backstop in the extended position from a raised location outside the cascade path to a lowered location in the cascade path.

20 Claims, 8 Drawing Sheets

(51) Int. Cl.

| | |
|---|---|
| ***B65H 31/10*** | (2006.01) |
| ***B65H 29/24*** | (2006.01) |
| ***B65H 31/30*** | (2006.01) |
| ***B65H 31/32*** | (2006.01) |

(56) References Cited

U.S. PATENT DOCUMENTS

| | | | | |
|---|---|---|---|---|
| 4,938,657 | A | 7/1990 | Benson et al. | |
| 5,368,288 | A | 11/1994 | Philipp et al. | |
| 5,370,382 | A | 12/1994 | Wetter | |
| 5,545,001 | A * | 8/1996 | Capdeboscq ..... | B65H 31/32<br>414/790.2 |
| 6,446,962 | B1 * | 9/2002 | Taffertshofer ..... | B65H 29/70<br>271/312 |
| 8,240,652 | B2 | 8/2012 | De Matteis et al. | |
| 2004/0188926 | A1 | 9/2004 | Tamura | |
| 2004/0227282 | A1 | 11/2004 | Grewe et al. | |
| 2008/0251984 | A1 | 10/2008 | Caron et al. | |
| 2012/0132091 | A1 | 5/2012 | Wyss | |
| 2016/0145072 | A1 | 5/2016 | Allen et al. | |

* cited by examiner

STACKER HOPPER WITH FEED INTERRUPT

CROSS-REFERENCE TO RELATED APPLICATIONS

The present application claims the benefit of U.S. Provisional Patent Application No. 62/256,421, filed Nov. 17, 2015, the entire contents of which is hereby incorporated by reference.

TECHNOLOGICAL FIELD

The present disclosure is directed to an accumulator for a hopper of a sheet stacking system, and to a method of operating the accumulator, and, more specifically, to a sheet stacking system having a hopper with an accumulator configured to interrupt a cascading flow of sheets exiting a conveyor and to support a partial stack of sheets while a main stack of previously deposited sheets is removed from beneath the accumulator.

BACKGROUND

A conventional stacking apparatus 10 is illustrated in FIG. 1. The stacking apparatus 10 is configured for use adjacent to a rotary die cut machine 12 which cuts blanks (not illustrated) from sheets of material, for example, corrugated paperboard. The stacking apparatus 10 includes a receiving or "layboy" section 14 that receives the blanks from the die cut machine 12 and discharges them onto a transfer conveyor 16. The transfer conveyor 16 carries the blanks to an inclined main conveyor 18, and the blanks travel along the main conveyor 18 to its downstream end 20 where they are discharged into a hopper 22.

After the blanks are discharged from the downstream end 20 of the main conveyor 18, they impact against a backstop 24 and fall either a) directly onto a discharge conveyor 28 or b) onto elevating fingers 26 which controllably lower stacks of the blanks onto the discharge conveyor 28. As the stack 30 on the elevating fingers 26 grows, the elevating fingers 26 drop, either continuously or periodically, so that the sheets leaving the main conveyor 18 are always falling approximately the same distance from the downstream end 20 onto the elevating fingers 26 or onto the partial stack 30 on the discharge conveyor 28. In other embodiments, the sheets may fall on a fixed height platform or conveyor, and the downstream end 20 of the main conveyor 18 may rise to stay a relatively fixed distance above the top of the growing stack 30.

When the stack 30 has reached a desired height, the elevating fingers 26 lower the stack 30 to a level even with the discharge conveyor 28, if elevating fingers 26 are used, and the discharge conveyor 28 moves the finished stack 30 away from the stacking apparatus 10. When the stack 30 has been transferred from the elevating fingers (or when the stack has moved away from the location beneath the hopper 22 if the stack was formed directly on the discharge conveyor 28), the elevating fingers 26 rise toward the hopper 22 for receiving additional sheets from the downstream end 20 of the main conveyor 18.

The rotary die cut machine 12 operates substantially continuously, and sheets of material therefore continue to traverse the stacking apparatus 10 and reach the hopper 22 even when a finished stack is being removed from the discharge conveyor 28 and/or when the elevating fingers 26 are lowering the stack 30 toward the discharge conveyor 28.

During the time that the stack 30 is being removed from beneath the hopper 22, accumulator shelves 32 are extended to receive sheets as they leave the downstream end 20 of the main conveyor 18. When a finished stack has been removed from beneath the hopper 22 and the elevating fingers 26 are back in position for receiving additional sheets, the accumulator shelves 32 retract and drop the sheets that have accumulated thereon onto the elevating fingers 26 or onto the discharge conveyor 28. Additional sheets exiting the downstream end 20 of the stacking apparatus 10 fall onto the stack, and the process repeats until the stack on the elevating fingers 26 or the discharge conveyor 28 reaches a desired height.

It is common to include a tamping device in the hopper 22. Such a tamping device repeatedly presses in against the stack on the accumulator shelves 32—either from one or both sides or from the front and/or back, to align or square the small stack on the accumulator shelves 32. It is often desirable to finish squaring or tamping the stack on the accumulator shelves 32 before withdrawing the accumulator shelves 32 and dropping the small stack onto the elevating fingers 26 or the discharge conveyor 28.

Modern rotary die cut machines and stackers operate at increasingly high speeds, and the number of sheets transported per minute is thus increasing. To maintain a high throughput, it is desirable to keep the rotary die cut machine and the stacker operating continuously. However, with present stacker designs, it is difficult or impossible to finish tamping a small stack of sheets on the accumulator shelves and drop that small stack from the accumulator before the next sheets start to fall from the end of the main conveyor. This is particularly true when the stackers employ a blowing device to cause the sheets exiting the discharge end of the main conveyor to fall faster than they would under the force of gravity alone, particularly in the case of large sheets that tend to float on a cushion of air as they drop. In such devices, it is difficult or impossible to consistently time accumulator operation so that a laterally extendable accumulator shelf can be inserted into a falling stack of sheets without either damaging the edges of the sheets or possibly causing a jam.

SUMMARY

These problems and others are addressed by embodiments of the present disclosure, a first aspect of which comprises a sheet stacking system including a conveyor configured to carry sheets from a conveyor intake end to a conveyor discharge end and having a hopper at the discharge end configured to receive the sheets ejected from the discharge end of the conveyor and guide the sheets as they fall in a cascade path onto a platform associated with the hopper. The falling sheets form a main stack on the platform. The hopper has a backstop facing the discharge end of the conveyor such that the sheets ejected from the discharge end impact against the backstop before forming the main stack. The system also includes a first accumulator comprising at least one first support extending through the backstop which support is shiftable from a retracted position to an extended position. The at least one first support is movable vertically relative to the backstop in the extended position from a raised location outside the cascade path to a lowered location in the cascade path.

Another aspect of the disclosure comprises a method of operating the above sheet stacking system that includes placing the at least one support in the extended position at the raised location, discharging sheets from the conveyor such that they impact the backstop below the at least one support and fall onto the platform or onto sheets supported by the platform to form the main stack, moving the at least one first support in the extended position from the raised location to the lowered location while the sheets fall along the cascade path, shifting the at least one second support from the retracted position to the extended position, and forming a first partial stack on the at least one first support and on the at least one second support above the main stack.

Yet another aspect of the disclosure comprises a sheet stacking system that includes a conveyor configured to carry sheets from a conveyor intake end to a conveyor discharge end and a hopper at the discharge end configured to receive the sheets ejected from the discharge end of the conveyor and guide the sheets as they fall in a cascade path onto a platform associated with the hopper. The falling sheets form a main stack on the platform. The hopper has a backstop facing the discharge end of the conveyor such that the sheets ejected from the discharge end impact against the backstop before forming the main stack. The system also includes an accumulator comprising at least one support extending through the backstop, the at least one support having a substantially horizontal upper support surface having a free end and a bottom surface extending away from the free end at an acute angle to the upper support surface and forming a triangle when viewed from a side of the hopper. The at least one support is shiftable from a retracted position to an extended position relative to the backstop, and the at least one support is movable vertically relative to the backstop in the extended position from a raised location to a lowered location

DETAILED DESCRIPTION

Figure 1:
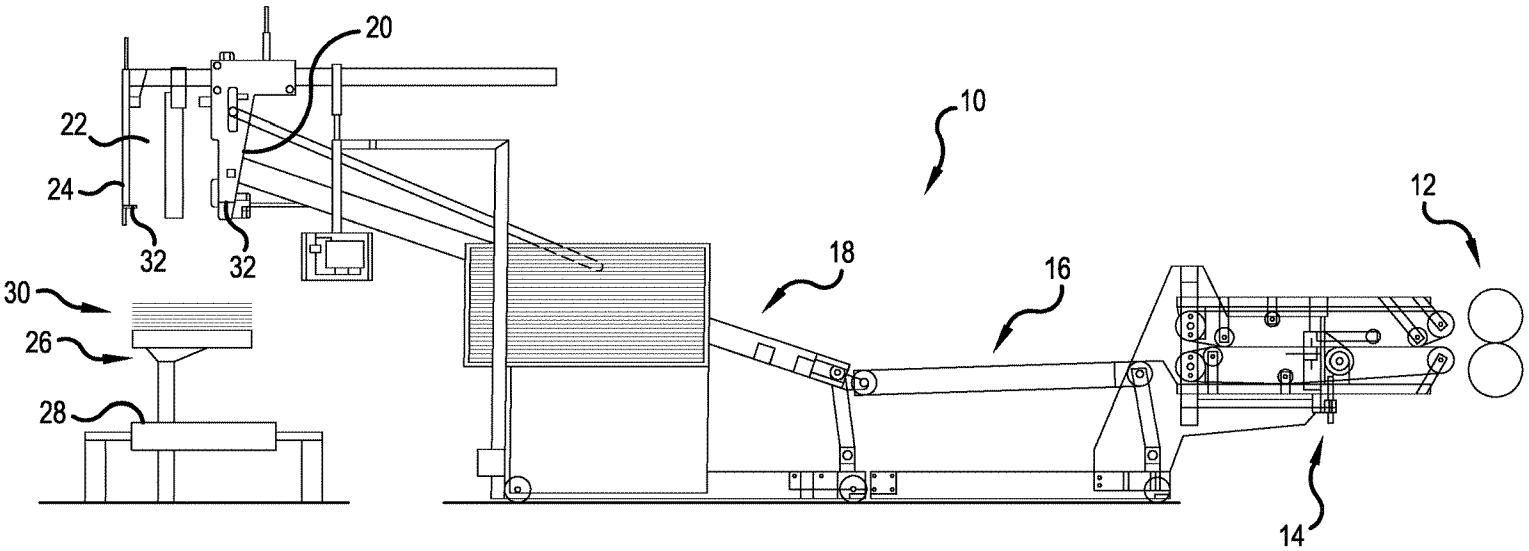
FIG.1 CONVENTIONAL ART
FIG. 1 is a schematic elevational view of a conventional rotary die cut machine and a conventional stacking system.
Figure 2:
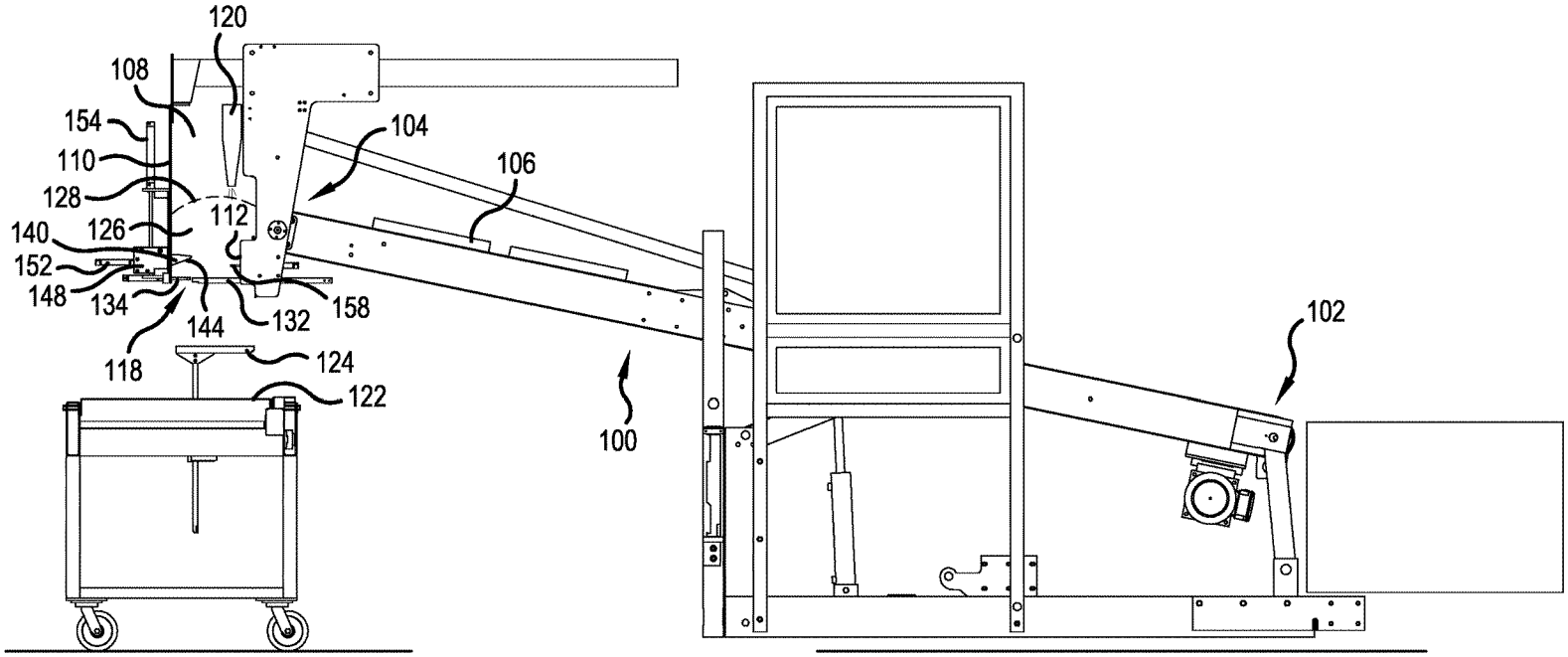
FIG. 2 is a schematic elevational view of a rotary die cut machine and a stacking system according to an embodiment of the present disclosure.
Figure 8:
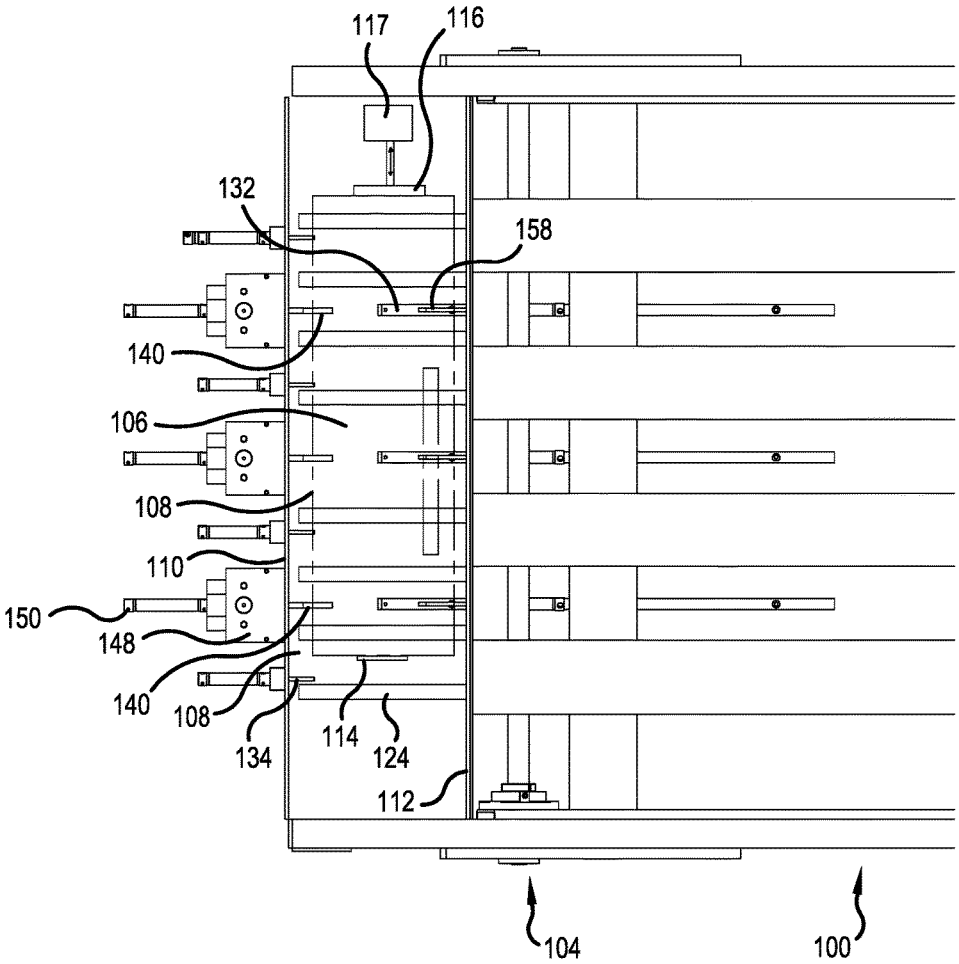
FIG. 8 is a top plan view of the discharge end of the stacking system of FIG. 2.
Figure 9:
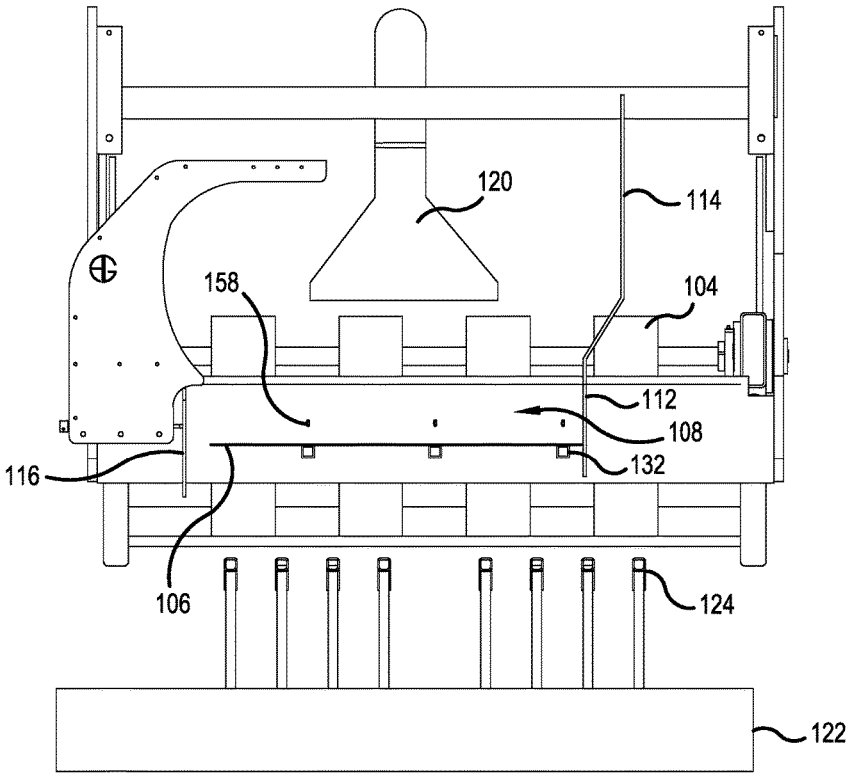
FIG. 9 is an end elevational view of the stacking system of FIG. 2 with the backstop removed for illustration purposes

Referring now to the drawings, wherein the showings are for purposes of illustrating embodiments of the disclosure only and not for the purpose of limiting same, FIG. 2 shows a main conveyor 100 having an intake end 102 and a discharge end 104 which is configured to carry sheets 106 in a sheet travel direction (sometimes referred to as a "downstream" direction) from the intake end 102 toward the discharge end 104. As the sheets 106 reach the discharge end 104, they are ejected into a hopper 108 which hopper 108 comprises, among other elements discussed hereinafter and best illustrated in FIG. 8, a backstop 110, a front wall 112, a fixed side guide 114, a movable side guide 116, and a bottom opening 108. The movable side guide 116 and an actuator 117 form a tamper for tamping or squaring stacks of sheets in the hopper 108.

The forward edges of the sheets 106 leaving the discharge end 104 of the main conveyor 100 begin to drop under the force of gravity and, optionally, the force of a downward flow of air produced by a blower 120. The downstream motion of each sheet 106 is arrested when the sheet 106 impacts against the backstop 110. This occurs at approximately the same time a trailing edge of the sheet 106 passes the discharge end 104 of the main conveyor 100, and each sheet 106 thus falls under the force of gravity, and optionally the force of the air flow produced by the blower 120, toward a receiving device which may comprise, for example, a conventional discharge conveyor 122 or elevating fingers 124. The present embodiment includes elevating fingers 124; however, persons of ordinary skill in the art will understand that the elevating fingers 124 could be omitted, for example, if the discharge end 104 of the main conveyor 100 can be raised during conveyor operation. The function of the hopper 108 remains substantially the same whether or not the elevating fingers 124 are used.

The sheets 106 are ejected substantially continuously from the discharge end 104 of the main conveyor 100 and form a cascade of sheets that travel along what is referred to herein as a "cascade path" 126. This cascade path 126 comprises the volume through which the sheets 106 pass between the discharge end 104 of the main conveyor 100 and the elevating fingers 124 or other receiving device. Much of the cascade path 126 is defined by the elements of the hopper 108, namely, the backstop 110, the front wall 112, the fixed side guide 114 and the movable side guide 116. Because the leading edges of the sheets 106 begin to drop toward the elevating fingers 124 before the trailing edge of the sheets 106 pass the discharge end 104, the upper edge 128 of the cascade path 126, shown by a dashed line in FIGS. 3 and 5, curves and meets the backstop 110 at a location that is lower than the discharge end 104 of the main conveyor 100.

If nothing obstructs the cascade path 126, the sheets leaving the discharge end 104 of the main conveyor 100 will land on the elevating fingers 124, or on sheets 106 that were previously deposited on the elevating fingers 124, and form a stack. The elevating fingers 124 are configured to lower stacks of the sheets 106 onto the discharge conveyor 122 so that the discharge conveyor 122 can move the finished stacks transverse to the downstream direction and away from the bottom opening 118 of the hopper for further processing. However, the flow of sheets 106 leaving the discharge end 104 of the main conveyor 100 does not stop while the elevating fingers 124 and the discharge conveyor 122 are removing finished stacks of the sheets 106. It is therefore necessary to provide at least one accumulator for catching and retaining falling sheets 106 until the elevating fingers 124 are back in position to receive the sheets 106 falling from the bottom opening 118 of the hopper 108.

The hopper 108 includes an accumulator shelf 132 that is shiftable between retracted and extended positions relative to the front wall 112 of the hopper 108 and accumulator pins 134 that are shiftable between retracted and extended positions relative to the backstop 110 of the hopper 108. It is known from the prior art to use an accumulator shelf to catch falling sheets while a finished stack is removed from below a hopper. However, as the speeds at which the rotary die cut machine and the main conveyor 100 increase, and especially when the blower 120 is used to make the sheets 106 fall through the hopper 108 faster than they would under the force of gravity alone, it becomes increasingly difficult to time the operation of an accumulator shelf so that it extends into a space between two falling sheets 106 rather than impacting the edge of a falling sheet and causing a jam.

To address this problem, the disclosed stacking system includes a novel accumulator 136 that may be used alone or together with another accumulator 138. The novel accumulator may be referred to hereinafter as the "first" accumulator and other accumulator as a "second" accumulator even though it is not always necessary to provide the second accumulator 138.

The first accumulator 136 comprises a plurality of first supports 140 that are configured to be selectably and controllably extended and retracted relative to the backstop 110. To this end, the backstop 110 may be formed from a unitary sheet of material having a plurality of parallel slits (not illustrated) or, alternately, formed as a plurality of closely spaced strips of material separated by elongated gaps through which the first supports 140 can project.

Figure 7:
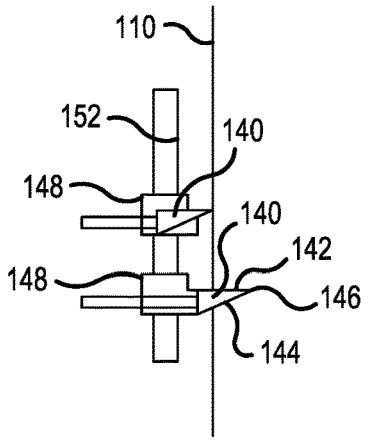
FIG. 7 is a schematic side elevation view of the interrupt fingers of the stacking system of FIG. 2 shown in extended and retracted positions.

Each of the first supports 140 has a generally horizontal top surface 142 (see FIG. 7) and an angled lower surface 144 that meets the top surface 142 at an acute angle at a tip 146. Each of the first supports 140 is slidably mounted in a housing 148 located on the opposite side of the backstop 110 from the main conveyor 100, which housing 148 also supports a horizontal actuator 150, which may comprise a pneumatic cylinder, for example. The horizontal actuator 150 is configured to extend in order to slide the first support 140 through the backstop 110 to an extended position and to retract to pull the first support 140 back into the housing 148 into a retracted position. FIG. 7 illustrates the first support 140 in the extended position and the retracted position; two configurations of the first support 140 are shown in two housings 148 on a single vertical shaft 152 for illustration purposes. Only one housing 148 is provided on each vertical shaft 152 in actual embodiments.

Figure 3:
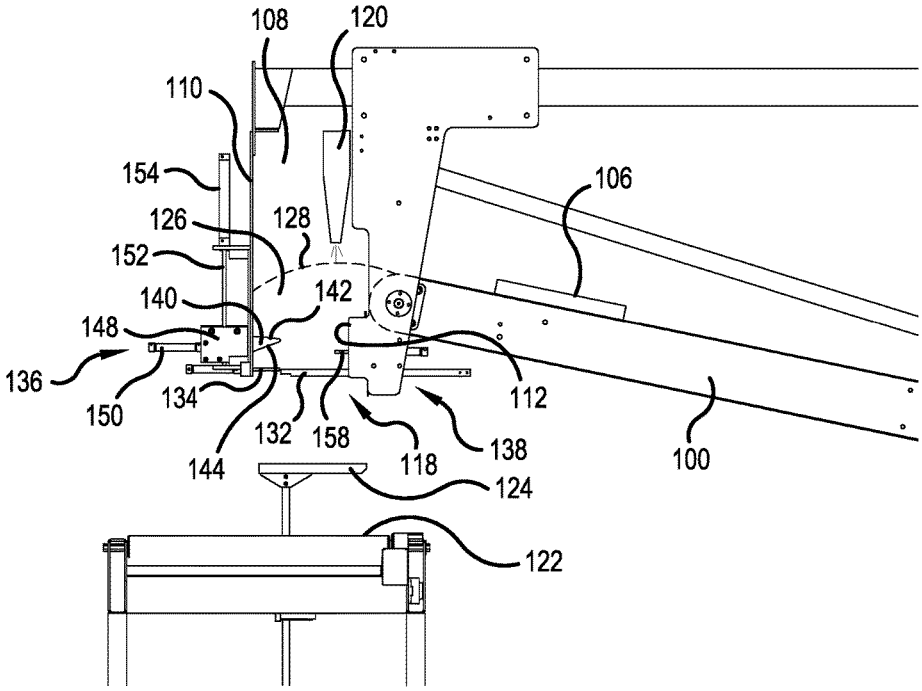
FIG. 3 is a detail view of the discharge end of the stacking system of FIG. 2.
Figure 4:
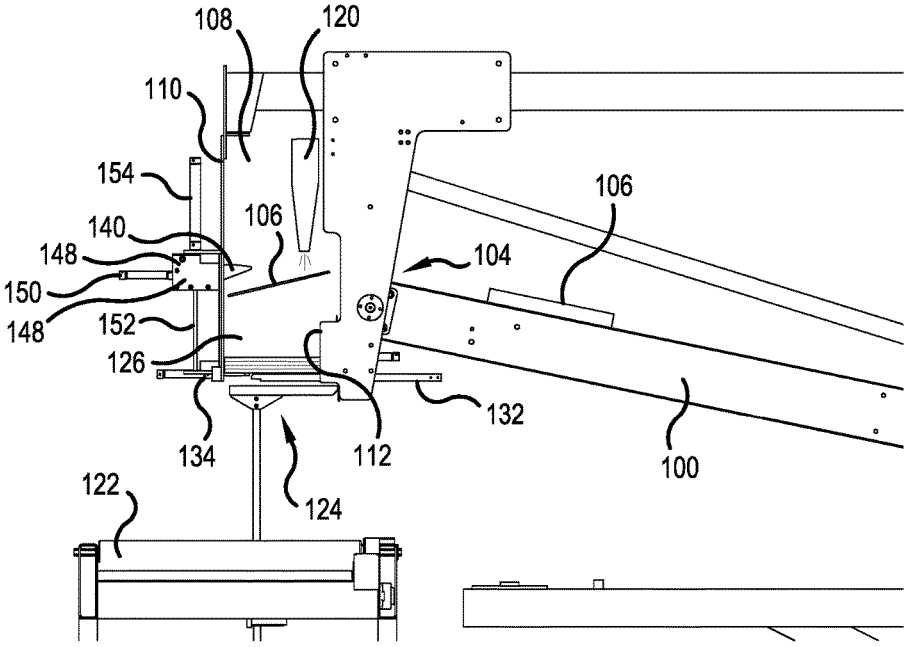
FIGS. 4-6 illustrate the formation of a stack at the discharge end of the stacking system of FIG. 2.
Figure 5:
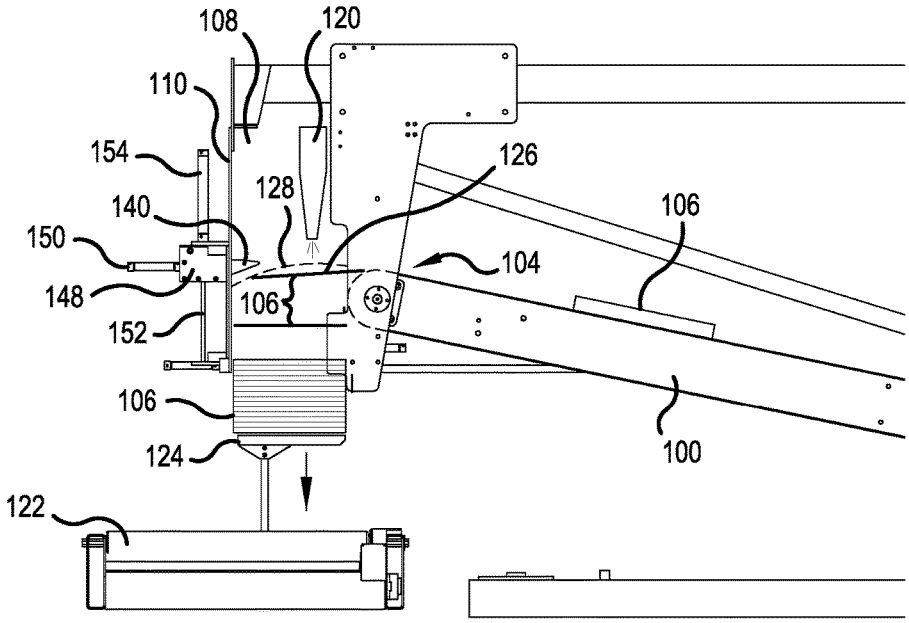

The housing 148 is also mounted for vertical sliding movement on the vertical shaft 152 under the control of a vertical actuator 154, another pneumatic cylinder, for example, for sliding movement between a raised location, illustrated in FIGS. 4 and 5, and a lowered location illustrated in FIGS. 2 and 3. The horizontal actuator 150 and the vertical actuator 154 are independently controllable by a suitable controller, which may comprise, for example, a microprocessor or a PLC, preferably the controller that controls other operations of the overall stacking system.

The first accumulator 136 also includes a plurality of second supports 158, in this case, a plurality of pins 158, that are configured to move between an extend position and a retracted position relative to the front wall 112 of the hoper 108. The pins 158 are vertically fixed and are located at the approximate level of the lowered location of the first supports 140. That is, when the first supports 140 are in the extended position at the lowered location and the pins 158 are in the extended position, the top surfaces 142 of the first supports 140 and the pins 158 support sheets 106 in the hopper 108 in a substantially horizontal orientation.

When the second supports 158 are in the retracted position, they are located outside the cascade path 126, and when the second supports 158 are in the extended position they extend into the cascade path 126. When the first supports 140 are in the retracted position, they are located outside the cascade path 126. When the first supports 140 are in the extended position, they are located outside the cascade path 126 when they are at the raised location and they are located in the cascade path 126 when they are at the lowered location.

The operation of the disclosed stacking system will now be described with reference to FIGS. 4-6.

In FIG. 4, the elevating fingers 124 are raised to a location near the bottom opening 118 of the hopper 108 and in position to receive sheets 106 from the hopper 108. The sheets 106 are supported by the accumulator shelf 132 and the pins 134 of the second accumulator 138, and additional sheets 106 are falling onto the partial stack on the second accumulator 138. The partial stack is also being tamped at this time by the action of the actuator 117 repeatedly pressing the movable side guide 116 against sheets 106 on the partial stack to square them against the fixed side guide 114. Because the elevating fingers 124 are in position to receive additional sheets 106, having just deposited a previous stack of sheets 106 on the discharge conveyor 122, for example, the controller causes the accumulator shelf 132 and the pins 134 to retract and drop the partial stack of sheets 106 onto the elevating fingers 124.

FIG. 5 shows the partial stack of sheets 106 supported on the elevating fingers 124 after being dropped from the second accumulator 138. The main conveyor 100 continues to eject sheets 106 from the discharge end 104 into the hopper 108, and the blower 120 moves the sheets 106 along the cascade path 126 to the top of the growing partial stack of sheets 106 on the elevating fingers 124. At this time, the elevating fingers 124 are lowered such that each of the sheets 106 falling from the discharge end 104 of the main conveyor 100 falls approximately the same distance onto the top of the growing partial stack.

When the partial stack has reached a desired size, the elevating fingers 124 must be lowered to place the now-finished stack on the discharge conveyor 122. However, because of the rapid rate at which the sheets 106 traverse the cascade path 126 and the small spacing between adjacent ones of the sheets 106, it is not practical to extend the accumulator shelf 132 and pins 134 of the second accumulator 138 into the cascade path 126. This is because it is likely that either the accumulator shelf 132 or the pins 134 will impact a side of one of the sheets 106 and misalign the sheets 106 in a manner that interferes with efficient stack formation and/or causes a jam that requires the rotary die cut machine and the main conveyor 100 to be stopped while the jam is cleared.

To avoid such a problem, the first accumulator 136 is actuated as follows. During the process of forming a partial stack on the second accumulator 138 and later on the elevating fingers 124, the first supports 140 of the first accumulator 136 have been in the raised location and the extended position (See FIGS. 4 and 5), and the pins 158 of the first accumulator 136 have been in the retracted position. The tips 146 of the first supports 140 are located outside the cascade path 126 as shown in FIGS. 4 and 5 because the leading edges of the sheets 106 drop under the forces of gravity and the airflow from the blower 120. The pins 158 are also retracted and located outside the cascade path 126 such that they do not interfere with the flow of sheets 106 along the cascade path 126 and through the hopper 108.

Figure 6:
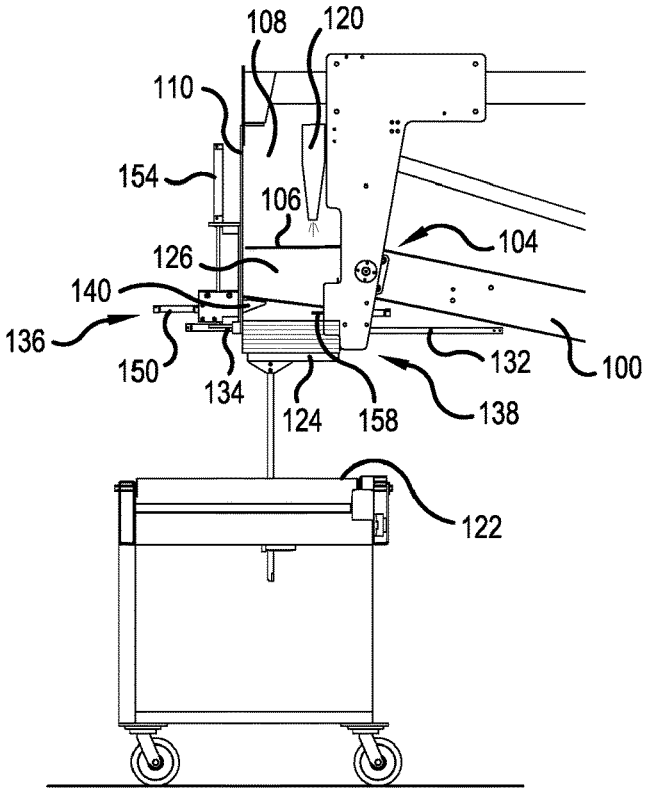

In order to interrupt the flow of the cascading sheets 106, the vertical actuator 154 is fired to rapidly drive the housing 148 downwardly and this moves the first support 140 downwardly into the lowered position illustrated in FIG. 6. This lowering takes place very quickly, on the order of a tenth of a second, and such that is appears substantially instantaneous to an observer. As the first support 140 travels in the downward direction, its angled lower surface 144 crosses the upper edge 128 of the cascade path 126 and enters into the cascade path 126. Because the sheets 106 at the location where the first support 140 enters the cascade path 126 tend to be oriented with their leading edges tipping downwardly, it is likely that an incoming sheet 106 will come into contact the first support 140 in one of two ways, neither of which will lead to a jam.

First, if the vertical actuator 154 fires when a sheet 106 is in the location illustrated in FIG. 5, with the leading edge of the sheet 106 below the angled lower surface 144 of the first support 140, the downward movement of the first support 140 will drive the angled lower surface 144 of the first support 140 into contact with the top of the sheet 106 and press the sheet 106 downwardly toward the stack forming on the elevating fingers 124. Alternately, if the vertical actuator 154 fires before the leading edge of the sheet 106 has reached a position beneath the angled lower surface 144, the first support 140 will reach the lowered location of FIG. 6 before the most recently ejected sheet 106 and it will be in position to receive the incoming sheet 106 on the horizontal top surface 142 thereof.

Because the angle of the angled lower surface 144 and the orientation of the sheets 106 exiting the discharge end 104 of the main conveyor 100, and the speed at which the first support 140 is moved from the raised location to the lowered location by the vertical actuator 154, it is nearly impossible to create a jam between an incoming sheet 106 and the tip 146 of the first support 140.

The pins 158 of the first accumulator 136 are shifted to the extended position at approximately the same time the first support 140 reaches the lowered location. Because of the manner in which the sheets 106 fall from the discharge end 104 of the main conveyor, larger gaps exist between the trailing edges of the falling sheets along the hopper front wall 112. It is therefore generally easier to time the movement of the pins 158 so that they do not impact against an edge of a falling sheet 106.

The first accumulator 136 then accumulates several sheets 106 while a final tamping is performed on the stack of sheets 106 on the elevating fingers 124, and the elevating fingers 124 drop from the position illustrated in FIG. 6 to place the finished stack of sheets 106 onto the discharge conveyor 122. Once the top of the stack of sheets 106 on the elevating fingers 124 has cleared the bottom opening 118 of the hopper 108, the accumulator shelf 132 and the pins 134 of the second accumulator 138 are shifted from their retracted positions to their extended positions. Because the incoming sheets are at this time still being caught by the first accumulator 136, there is no danger of driving the edge of the accumulator shelf 132 into the edge of a falling sheet 106 and there is no need to precisely time the shifting of the second accumulator to the extended position.

With the second accumulator 138 in position, the pins 158 of the first accumulator 136 are retracted and the first supports 140 of the first accumulator 136 are retracted by the horizontal actuator 150. With the first supports 140 including their tips 146 completely out of the cascade path 126, the vertical actuator 154 shifts the housing 148 back to the raised location and the horizontal actuator 150 shifts the first supports 140 into the extended position of FIG. 4 at which point the cycle repeats.

The present invention has been described herein in terms of a preferred embodiment. However, modifications and additions to this disclosure will become apparent to those of ordinary skill in the art upon a reading of the foregoing detailed description. For example, while the stacking system of the disclosed embodiment includes first and second accumulators, it is possible to use the disclosed first accumulator as the only accumulator in a stacking system. It is intended that all such additions and modifications form a part of the present invention to the extent they fall within the scope of the several claims appended hereto.

We claim:

1. A sheet stacking system comprising:

a conveyor configured to carry sheets from a conveyor intake end to a conveyor discharge end;

a hopper at the discharge end configured to receive the sheets ejected from the discharge end of the conveyor and guide the sheets as they fall in a cascade path onto a platform associated with the hopper, the falling sheets forming a main stack on the platform, the hopper including a backstop facing the discharge end of the conveyor such that the sheets ejected from the discharge end impact against the backstop before forming the main stack, and a first accumulator mounted on and supported by the hopper, the first accumulator comprising a carrier and at least one first support extending from the carrier through the backstop, the at least one first support being shiftable from a retracted position to an extended position relative to the backstop, the carrier being configured to move linearly and vertically relative to the backstop with the at least one first support in the extended position from a raised location with the at least one first support outside the cascade path to a lowered location with the at least one first support in the cascade path.

2. The sheet stacking system according to claim 1, wherein the carrier is configured to move from the raised location to the lowered location when the at least one first support is in the extended position and is configured to move from the lowered location to the raised location when the at least one support is in the retracted position.

3. The sheet stacking system according to claim 2, including at least one second support below the conveyor discharge end configured to shift between a retracted position outside the cascade path and an extended position in the cascade path, the at least one second support being located substantially horizontally across the hopper from the at least one first support when the carrier is in the lowered location.

4. The sheet stacking system according to claim 3, wherein the hopper includes a front wall facing and spaced from the backstop and at least partially defining the cascade path and wherein the at least one second support is located at the front wall.

5. The sheet stacking system according to claim 4 including a blower configured to blow air from above the cascade path toward the platform.

6. The sheet stacking system according to claim 3, further including a second accumulator beneath the lowered location of the at least one first support of the first accumulator.

7. The sheet stacking system according to claim 6, further including a tamper configured to square a first partial stack of sheets on the second accumulator.

8. The sheet stacking system according to claim 7, wherein the tamper comprises a hopper wall configured to move toward and away from the first partial stack of sheets.

9. The sheet stacking system according to claim 8, wherein the tamper is configured to square a second partial stack of sheets on the first accumulator.

10. The sheet stacking system according to claim 1, wherein the at least one support includes a substantially horizontal upper support surface having a free end and a bottom surface extending away from the free end at an acute angle to the upper support surface.

11. The sheet stacking system according to claim 1, wherein the at least one support includes a substantially horizontal upper support surface and is substantially triangular when viewed perpendicular to a direction of the cascade path.

12. The sheet stacking system according to claim 1, wherein the at least one first support includes a support surface extending from the backstop at an angle, and wherein the angle remains constant when the carrier moves the at least one first support relative to the backstop.

13. The sheet stacking system according to claim 1, wherein the first accumulator includes a first actuator supported by the hopper and configured to move the at least one first support between the extended position and the retracted position and a second actuator supported by the hopper and configured to move the at least one first support vertically relative to the backstop.

14. The sheet stacking system according to claim 1, wherein the hopper is mounted on and supported by the conveyor.

15. The sheet stacking system according to claim 1, wherein the carrier is located outside the hopper.

16. A method of operating a sheet stacking system, the sheet stacking system comprising:

a conveyor configured to carry sheets from a conveyor intake end to a conveyor discharge end;

a hopper at the discharge end configured to receive the sheets ejected from the discharge end of the conveyor and guide the sheets as they fall in a cascade path onto a platform associated with the hopper, the falling sheets forming a main stack on the platform, the hopper including a backstop facing the discharge end of the conveyor such that the sheets ejected from the discharge end impact against the backstop before forming the main stack, a first accumulator mounted on and supported by the hopper, the first accumulator comprising a carrier and at least one first support extending from the carrier through the backstop, the at least one first support being shiftable from a retracted position to an extended position relative to the backstop, the carrier being movable linearly and vertically relative to the backstop with the at least one first support in the extended position between a raised location with the at least one first support outside the cascade path and a lowered location with the at least one first support in the cascade path, and at least one second support below the conveyor discharge end configured to shift between a retracted position outside the cascade path and an extended position in the cascade path, the at least one second support being located substantially horizontally across the hopper from the at least one first support when the at least one first support is in the lowered location, the method comprising:

placing the at least one support in the extended position and the carrier at the raised location;

discharging sheets from the conveyor such that they impact the backstop below the at least one support, while the at least one support is in the extended position, and fall onto the platform or onto sheets supported by the platform to form the main stack, moving the carrier, with the at least one first support in the extended position, from the raised location to the lowered location while the sheets fall along the cascade path, shifting the at least one second support from the retracted position to the extended position, and forming a first partial stack on the at least one first support and on the at least one second support above the main stack.

17. The method of claim 16, wherein the sheet stacking system further includes a second accumulator beneath the at least one first support of the first accumulator when the carrier in in the lowered location, the method further including:

retracting the at least one first support and retracting the at least one second support to drop the first partial stack onto the second accumulator, and shifting the carrier to the raised location, and shifting the at least one first support to the extended position.

18. The method according to claim 17, including tamping the first partial stack and discharging additional sheets from the conveyor onto the first partial stack to form a second partial stack.

19. The method according to claim 16, wherein the hopper is mounted on and supported by the conveyor.

20. The method according to claim 16, wherein the carrier is located outside the hopper.

* * * * *